United States Patent [19]

Nakamura et al.

[11] 3,945,185

[45] Mar. 23, 1976

[54] PNEUMATIC AND STATIC ELECTRICITY OPEN-END SPINNING METHOD AND APPARATUS THEREFOR

[75] Inventors: Minoru Nakamura, Amagasaki; Shin Kosaka, Itami, both of Japan

[73] Assignee: Osaka Kiko Co., Ltd., Osaka, Japan

[22] Filed: Dec. 13, 1974

[21] Appl. No.: 532,492

[30] Foreign Application Priority Data

Dec. 19, 1973 Japan ..... 48-143121

[52] U.S. Cl. ..... 57/58.95; 57/58.91

[51] Int. Cl.[2] ..... D01H 1/12

[58] Field of Search ..... 57/58.89–58.95, 36, 57/34 R, 156

[56] References Cited

UNITED STATES PATENTS

| | | | |
|---|---|---|---|
| 3,411,284 | 11/1968 | Corbaz et al. | 57/58.91 |
| 3,492,804 | 2/1970 | Landwehrkamp et al. | 57/58.95 X |
| 3,665,695 | 5/1972 | Amato | 57/58.91 |
| 3,673,781 | 7/1972 | Breitenbach | 57/58.89 |
| 3,696,600 | 10/1972 | Mayer, Jr. et al. | 57/58.95 X |
| 3,696,603 | 10/1972 | Kotter et al. | 57/58.89 |
| 3,699,766 | 10/1972 | Archambault | 57/58.91 |
| 3,744,231 | 7/1973 | Tannas, Jr. et al. | 57/58.91 X |
| 3,768,243 | 10/1973 | Brown et al. | 57/58.89 |

*Primary Examiner*—John Petrakes
*Attorney, Agent, or Firm*—Paul & Paul

[57] ABSTRACT

Open-end spinning is accomplished by means of placing similar static electricity charges on an anode member and an inlet anode nose member mounted in a spinning chamber near a feed roller, and by placing a charge opposite said anode member on a cathode member mounted at a downstream portion of the apparatus; introducing an air stream through said inlet anode nose member into said spinning chamber and discharging it through an outlet opening; within said spinning chamber, separating a single fiber from the strand of sliver or roving delivered from feed rollers; charging said single fiber with the same charge of static electricity as the inlet anode nose member, and; hoisting said single fiber into a yarn extending upstream from a twister.

10 Claims, 9 Drawing Figures

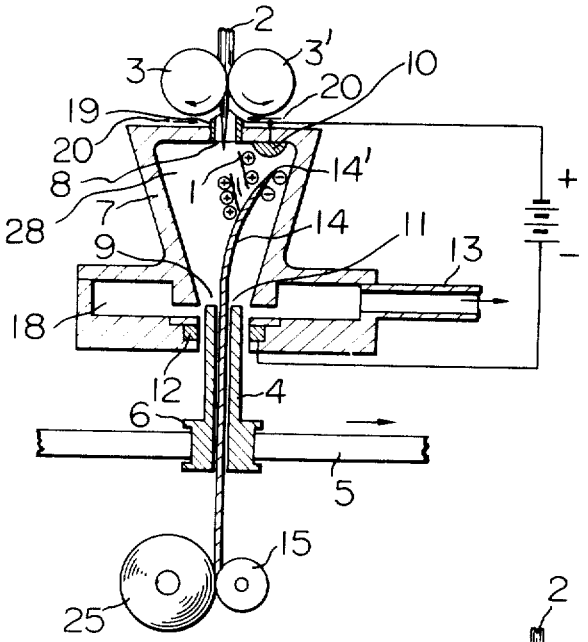
Fig. 1
Fig. 2
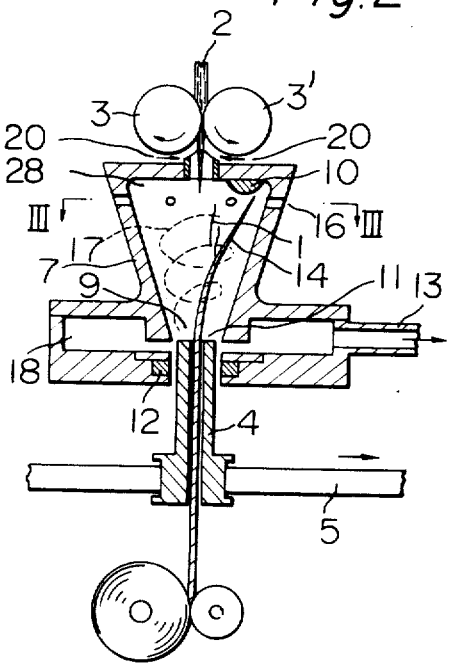
Fig. 3
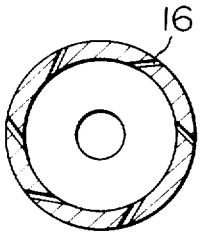

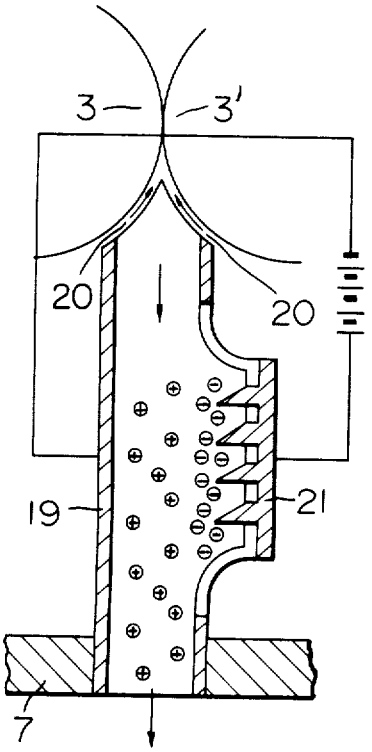
Fig. 8
Fig. 9
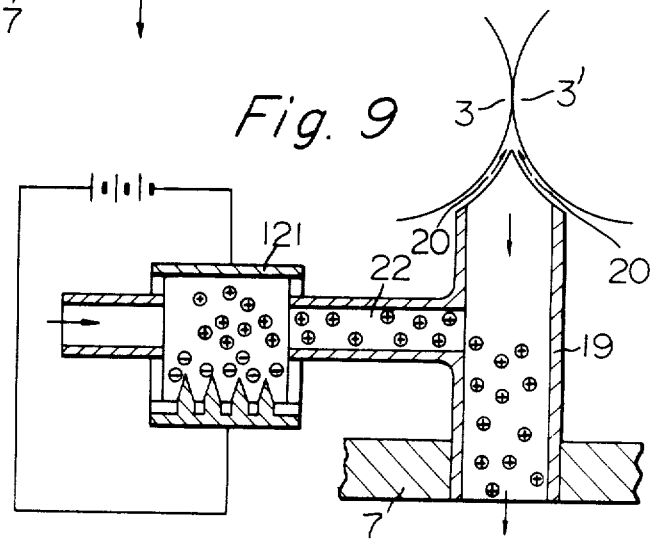

PNEUMATIC AND STATIC ELECTRICITY OPEN-END SPINNING METHOD AND APPARATUS THEREFOR

This invention relates to a spinning unit of a textile machine for spinning a continuously moving yarn by means of an open-end spinning system using static electricity. More particularly it relates to a pneumatic and static electricity open-end spinning method and apparatus therefor, which apparatus comprises a stationary spinning chamber with large cavity arranged downstream of a feed roller, and said chamber is provided with an inlet anode nose member and an anode member on its wall near said feed rollers, a cathode ring is provided downstream of said chamber, a twister is rotatably mounted downstream of said outlet opening of said chamber, and a suction source which sucks the air from the spinning chamber.

Although many attempts have been made to spin a yarn by means of an open-end system, using static electricity none have been successful to date. However, if successful there would be several advantages to such a system. One advantage is the yarn spun by means of a static electricity method will have a good orientation of the fibers contained therein. A further advantage of this method is that a twisting element running at high speed can be used, because such twister has a small mass, which means that the amount of power consumed in rotating said twister is small.

One such device has an apparatus which comprises, feed rollers charged with positive static electricity and a rotating twisting member, with an cathode member, spaced from said feed roller. By placing a high voltage charge on said feed rollers and said cathode member, the separated fiber receives a plus charge of static electricity while being transported in the electrostatic field to the twisting member and, then, is twisted into a yarn by said twisting member. However, even with such an apparatus, there are some drawbacks, one of which being that the electrostatic field is not enclosed. Therefore, some of the fibers will fly out of the electrostatic field and become waste fibers during the spinning operation, and such waste fibers make the air surrounding said spinning unit dirty. Furthermore, another drawback is that sometimes the free fibers are wrapped around the feed rollers, which results from the fact that, two adjacent fibers delivered from the feed rollers have a tendency to separate from each other, because said two fibers are similarly charged with a plus charge received from the feed rollers charged with the positive static electricity. Once this wrapping of a fiber around the feed rollers occurs, it results in the stable spinning condition being disturbed.

An object of the present invention is to provide an open-end spinning method, which has none of the above mentioned drawbacks, using pneumatic air and static electricity.

A further object of the present invention is to provide an open-end spinning apparatus which cleans the inside of the spinning chamber continuously by generating a vortex air flow.

A still further object of the present invention is to provide a stabilized spinning condition by using an ionized air flow within the cavities of the present apparatus.

The invention will be described by reference to specific embodiments thereof, as illustrated in the accompanying figures, wherein:

FIG. 1 is a diagramatic sectional view of the present open-end spinning unit;

FIG. 2 is a sectional view similar to FIG. 1, showing a spinning unit using vortex air flow;

FIG. 3 is a sectional view taken along the line III—III in FIG. 2;

FIG. 8 and FIG. 9 are enlarged sectional views of the ionizers which can be used for the embodiment of FIG. 7.

Figure 4:
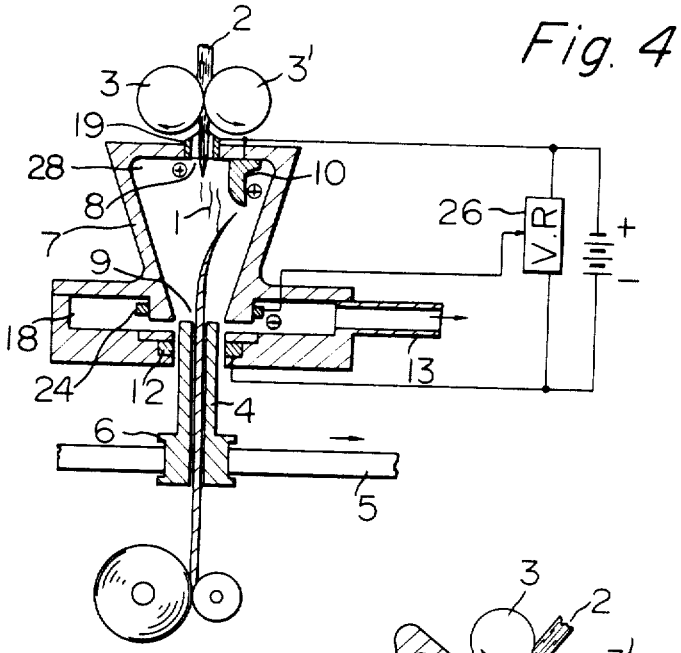
FIG. 4 is a sectional view similar to FIG. 1, showing an improved embodiment of the present invention.

In the apparatus as shown in FIG. 1, a strand of sliver or roving 2 is attenuated by means of proper apparatus into a lighter strand, and then said strand is fed from the feed rollers 3, and 3' to a spinning chamber 7. Downstream and in the vicinity of said feed roller, there is a spinning chamber 7 which is stationarily mounted on the frame of a spinning machine (not shown). Said chamber 7 has a large cavity 28 within it, and at the top of said cavity there is an inlet anode nose member 19 with a center hole 8, while at the bottom of said cavity there is an outlet opening 9. A twister 4, rotatably mounted to the frame (not shown), is arranged downstream of and concentrically with said outlet opening 9, and said twister 4 is turned by a motor (not shown) via an engagement between a tangential belt 5 and a wharve 6 of said twister 4. This twister 4 has a center hole, to twist the yarn being spun by this apparatus, and said twister may be of any conventional type commonly used in the textile machinery field.

At the bottom of said chamber, there is a surrounding cavity 18 which communicates with the cavity 28 through a narrow opening defined by the inner diameter of said outlet opening 9 and the outer diameter of the twister 4, and also communicates with the suction source (not shown) via an air discharging tube 13. Said surrounding cavity 18 encircles said outlet opening 9 and the top part of said twister 4.

At the bottom of said spinning chamber 7, a cathode ring 12 is fixedly mounted to said chamber, and said cathode ring is arranged concentrically with the top part of said twister 4, but with a clearance between the inside of said cathode ring 12 and the outside of said twister 4. Downstream of said twister 4 there is a winding drum 15 rotatably mounted on a frame (not shown), which drives a package 25, on which a yarn spun by this apparatus is wound.

Within the top part of said cavity 28 and a short distance away from the inlet anode nose member 19, an anode member 10 is mounted against the top inner wall of the spinning chamber 7. By connecting the inlet anode nose member 19 and said anode member 10 in series to the plus terminal of an electric source, while the cathode ring 12 is connected to the minus terminal of the electric source, the inlet anode nose member 19 and said anode member 10 are always charged with plus static electricity, while the cathode ring 12 is always charged with minus static electricity.

The open-end spinning operation of the present invention is accomplished as follows. By the rotation of feed rollers 3 and 3', the strand 2 is delivered into the center hole 8 of the inlet anode nose member 19, and a single fiber 1, contained within said strand 2, which is free of the holding action by the feed rollers 3 and 3', can be separated from the strand 2 and pulled toward the yarn tail 14'.

Because the inlet anode nose member 19 is always charged with plus static electricity, the single fiber 1 is charged with plus static electricity as soon as it passes through the center hole 8 of said inlet anode nose member 19. A yarn tail 14' of a spun yarn 14 extending upwardly from the twister 4 after-passing through the hole of twister 4, alternately touches or separates from the anode member 10. Because said yarn tail 14' of said spun yarn 14 passes through the center of the cathode ring 12, which always carries a minus charge of static electricity, said yarn tail 14' is charged with minus static electricity. Therefore, the front end of said single fiber 1 charged with plus static electricity adheres to the surface of the yarn tail 14'. The air flow 20 flows into the center hole 8 after passing through the narrow clearance defined by the outer surface of the feed rollers 3 and 3', and the inlet anode nose member 19. This air flow flows downwardly along the yarn 14, passes through the opening between the outlet opening 9 and the top part of the twister 4, enters into the surrounding cavity 18 and, finally, is delivered from the cavity 18 via the discharging tube 13 to the suction source (not shown).

Because the part of the yarn 14 within the chamber 7 is turned according to the rotation of the twister 4, a single fiber 1 connected by its front end to the outer surface of said yarn tail 14' is twisted around the surface of said yarn tail 14' and, thus, said fibers 1 can be spun into a spun yarn 14. As the single fiber 1 situated between the strand 2 and the yarn 14, and also moving toward the yarn 14, is straight, the yarn 14 spun by said single fibers 1 is a yarn of good fiber orientation.

In this embodiment, the feed rollers 3 and 3', are not connected to the electric source and, therefore, said feed rollers are never charged by static electricity. Consequently the strand 2 just delivered from the feed rollers 3 and 3' is not charged with static electricity, but is charged with static electricity as soon as it passes through the inlet anode nose member 19. Thus the fibers contained in said strand 2 just delivered from the feed rollers 3 and 3' will not separate from each other as in the case of the conventional apparatus. Therefore, the tendency of the separated fibers to wrap themselves around the feed rollers does not exist.

Furthermore, because the clearance between the feed rollers 3 and 3' and the outside of the nose member 19 is very narrow, the velocity of the air 20 passing through said clearance is very high and the direction of flow of said air 20 is opposite the running direction of the surface of the feed rollers 3 and 3'. This means that the end of a fiber laying on the surface of the feed rollers 3 and 3' is stripped from the surface of the feed rollers 3 and 3' by the air 20 and, then, guided to the inside of the center hole 8 of the nose member 19 and, finally, into the cavity 28. This means that the tendency of the fibers to wrap themselves around the feed rollers can be effectively prevented.

In the arrangement as shown in FIG. 1, the anode member 10, the inlet anode nose member 19 and the cathode ring 12 are installed on the spinning chamber 7 which is stationarily mounted on the frame (not shown). Therefore there is no requirement for a slip ring arranged between the electric source and the above mentioned members. This means that the electrical connection is very simple, and very steady. In practice, the voltage between the anode members and the cathode member is very high, such as for example, 30,000 volts.

The anode member 10 must be arranged as near as possible to the nose member 19, because by this arrangement the static charges on the anode member 10, nose member 19, and the cathode ring 12 act ideally for openend spinning. Because the anode member 10 is situated in the vicinity of, but not on, a line passing through the centers of the nose member 19 and the twister 4, the connection of a single fiber 1 to the yarn tail 14' is done uniformly, which results in the produced yarn having good uniformity.

In an improved embodiment of the apparatus shown in FIG. 1, a plurality of inlet holes 16 are formed in the wall of the spinning chamber 7, as shown in FIGS. 2 and 3. By providing said inlet holes 16 drilled almost tangentially to the inner surface of the cavity 28, a vortex air flow 17 is easily induced by the air flow passing through the opening defined by the outlet opening 9 and the twister 4. Because this vortex air flow 17 always cleans the accumulated fibers on the inner surface of the cavity 28 of the spinning chamber 7, such accumulated fibers are never twisted in to the yarn 14 and, therefore, the quality of the yarn is never reduced due to the inclusion of such fibers therein. An additional advantage of the vortex air flow is that said air flow assists the twisting of a fiber 1 into the yarn 14, which means that the twisting efficiency can be improved.

Figure 5:
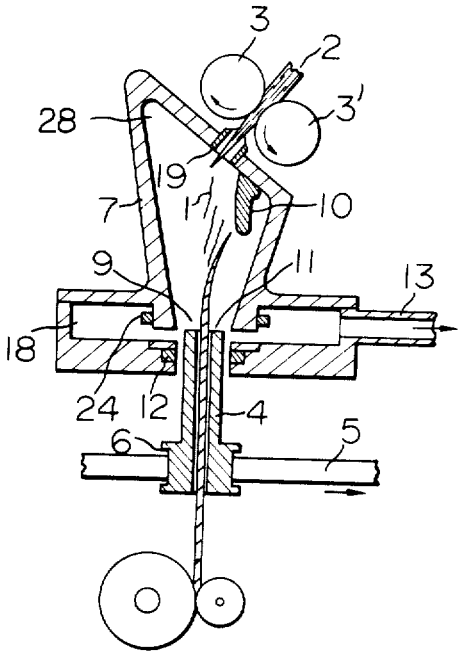
FIG. 5 is a sectional view similar to FIG. 1, showing another embodiment of the present invention as shown in FIG. 4.
Figure 6:
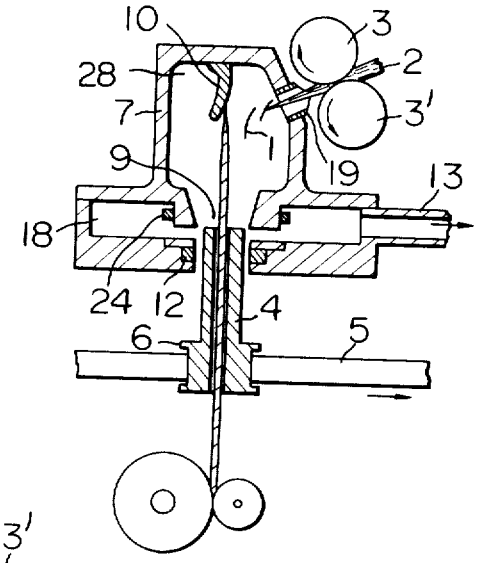
FIG. 6 is a sectional view similar to FIG. 1, showing a further embodiment of the present invention as shown in FIG. 4.

Although the inlet anode nose member 19 and the twister 4 are arranged coaxially to each other in the drawings of FIG. 1 and FIG. 2, a similar result can also be expected in the arrangements as shown in FIG. 5 and FIG. 6. In the arrangement of FIG. 5, the axis of said inlet anode nose member 19 is inclined to the axis of the twister 4. In the arrangement of FIG. 6, the incline between the two axes is much larger than in the case of FIG. 5, and, further, the anode member 10 is arranged almost in line with the axis of the twister 4.

In the embodiment shown in FIG. 4, a secondary cathode ring 24 is arranged concentrically with the outlet opening 9, and is connected in series to the cathode ring 12 via a variable resistor 26.

The secondary cathode ring 24 can operate like so called control pole. After many tests of several different arrangements of said ring 24 and the voltage for it, the results show that the best effect of the static electricity can be obtained by adjusting the position of said ring 24, and also by varying the voltage being placed thereon.

Figure 7:
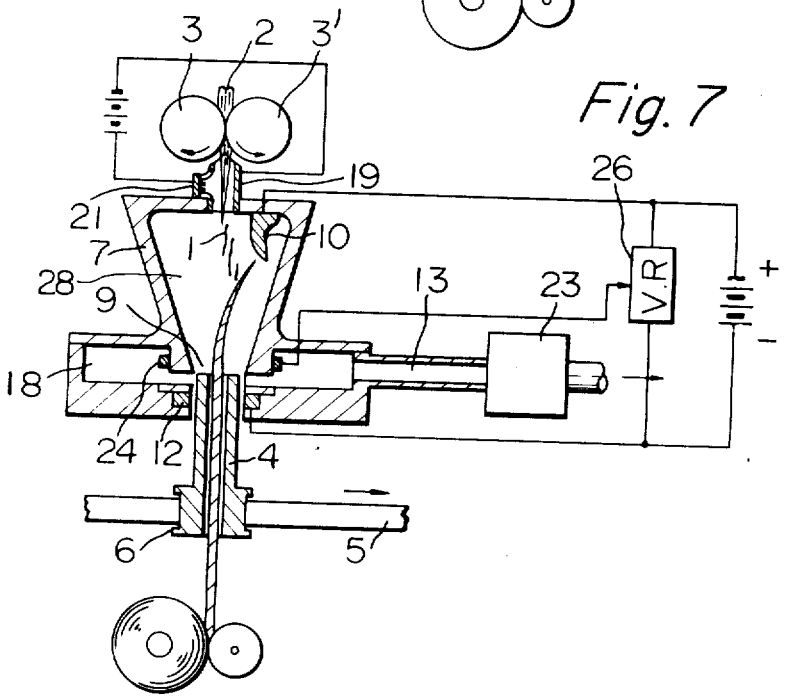
FIG. 7 is a sectional view similar to FIG. 1, showing an improved embodiment of the present invention as shown in FIG. 1.

In the embodiment shown in FIG. 7, the inlet anode nose member is replaced by an ionizing member 21, as shown in detail in FIG. 8, which member 21 is charged with plus static electricity by a separate source. An improved embodiment of the nose member 19, is shown in FIG. 9. In this embodiment an ionizing anode member 121 is additionally provided the nose member 19. In these arrangements, ionized air can flow into the cavity 28 via the ionizing member 21 or the ionizing anode member 121 of the nose member 19. The strand 2 and the fibers 1 are charged by static electricity as soon as they pass through the nose member 19, or ionizing member 21 because of the ionized air flowing there through. The ionized air must of course, be restricted to within the cavity 28 and the surrounding cavity 18 because it is harmful to humans. Therefore, to prevent the discharge of the ionized air into the surrounding environment a neutralizer 23 is provided in the air discharging tube 13, so that said ionized air is converted into non-ionized air prior to being discharged.

In the apparatus of this invention, the strand of sliver 2 can be fed to the feed rollers 3 and 3' by passing through conventional drafting assembly 1 or by means of combing roller mounted by the combing teeth.

As described above, in the present invention, by the combination of the single fiber 1 being charged with static electricity and the prevention of the wrapping of fibers around the feed rollers by the air flow a good open-end spinning condition can be generated. In addition, by providing a secondary anode ring 24 at an optimum position and constructing the inside surface of the hole of the twister from non-electrically conductive material, drawbacks such as the generation of fly waste can be completely prevented.

What is claimed is:

1. A pneumatic and static electricity open-end spinning method, characterized in:

charging an inlet anode nose member and an anode member arranged near said nose member and mounted on the wall of a spinning chamber near feed rollers, and oppositely charging a cathode member mounted at a downstream portion of said chamber;

introducing an air stream from said inlet anode nose member into said spinning chamber and discharging it through an outlet opening;

within said spinning chamber, charging a single fiber with the same charge as the anode nose member which fiber has been separated from a strand of sliver or roving being delivered from a feed roller;

twisting said single fiber into a yarn projecting upwardly from a twister rotating continuously and arranged downstream of said spinning chamber.

2. An electrostatic and pneumatic open-end spinning apparatus, comprising:

a feed roller;

a stationary spinning chamber with a large cavity arranged downstream of said feed roller;

an inlet anode nose member, charged with static electricity, mounted in said spinning chamber with a narrow clearance between itself and the feed roller;

an anode member, charged with the same charge as said nose member, arranged near but spaced from the inlet anode nose member, and mounted in said spinning chamber;

a rotating twister arranged at a downstream position;

a cathode ring; charged oppositely from the anode member, arranged coaxially with said twister but not in contact with the twister;

a suction source which draws air through the inlet anode nose member into the spinning chamber and then, out of the spinning chamber.

3. An electrostatic and pneumatic open-end spinning apparatus, comprising:

a feed roller;

a stationary spinning chamber with a large cavity arranged downstream of said feed roller;

an inlet anode nose member, charged with static electricity, mounted in said spinning chamber and arranged close to the feed roller with narrow clearance;

an anode member, charged similarly as said nose member, arranged near but spaced from the inlet anode nose member, and mounted in said spinning chamber;

a rotating twister arranged at a downstream position, and charged opposite to the anode member;

a suction source draws an air passing through the inlet anode nose member and drawn from the spinning chamber.

4. An apparatus as claimed in claim 2, further comprising a plurality of inlet holes which are formed in the wall of the spinning chamber tangentially to the inner wall thereof and which communicate the large cavity with the air surrounding the apparatus.

5. An apparatus as claimed in claim 2, wherein the inlet cathode nose member is arranged coaxially with the twister.

6. An apparatus as claimed in claim 5, wherein the cathode member is arranged almost in line with the axis of the twister.

7. An apparatus as claimed in claim 6, further comprising, a variable rheostat which acts to vary the voltage of static electricity placed on the secondary cathode member.

8. An apparatus as claimed in claim 2, wherein the axis of the inlet cathode nose member is inclined to the axis of the twister.

9. An apparatus as claimed in claim 2, further comprising, a secondary cathode member, which is charged similarly to the cathode member, and is arranged between the anode member and the cathode member.

10. An apparatus as claimed in claim 2, wherein the inlet cathode nose member is replaced by an ionizing member which generates ionized air charged with static electricity similar to the anode member.

* * * * *